US010160104B2

(12) United States Patent
Hu

(10) Patent No.: US 10,160,104 B2
(45) Date of Patent: Dec. 25, 2018

(54) AXIS FIXING DEVICE FOR A RATCHET WRENCH AND RATCHET WRENCH INCLUDING THE SAME

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 176 days.

(21) Appl. No.: 15/271,300

(22) Filed: Sep. 21, 2016

(65) Prior Publication Data

US 2017/0120426 A1 May 4, 2017

(30) Foreign Application Priority Data

Nov. 2, 2015 (TW) ..... 104136055 A

(51) Int. Cl.
*B25B 23/00* (2006.01)
*B25B 21/00* (2006.01)
*B25B 13/46* (2006.01)

(52) U.S. Cl.
CPC ..... *B25B 23/0035* (2013.01); *B25B 13/465* (2013.01); *B25B 13/467* (2013.01); *B25B 21/00* (2013.01); *B25B 21/005* (2013.01); *B25B 23/0021* (2013.01)

(58) Field of Classification Search
CPC . B25B 23/0021; B25B 13/465; B25B 13/467; B25B 21/005
USPC ..... 81/63.1
See application file for complete search history.

(56) References Cited

U.S. PATENT DOCUMENTS 4,311,072 A 1/1982 Hudgins
4,448,095 A 5/1984 Blodgett
5,058,463 A 10/1991 Wannop
5,709,136 A 1/1998 Frenkel
6,070,499 A * 6/2000 Wisbey ..... B25B 13/467 81/57.29
6,568,298 B1 5/2003 Zinck
6,789,447 B1 9/2004 Zinck
7,571,668 B1 * 8/2009 Chang ..... B25B 13/463 81/57.29
9,038,505 B2 * 5/2015 He ..... B25B 17/00 81/57.29
9,193,056 B2 11/2015 Lin
2004/0226411 A1 * 11/2004 Hsien ..... B25B 13/463 81/57.13

FOREIGN PATENT DOCUMENTS

TW 200812757 A 3/2008
TW M333996 U 6/2008
(Continued)

*Primary Examiner* — Hadi Shakeri

(74) *Attorney, Agent, or Firm* — Alan D. Kamrath; Kamrath IP Lawfirm, P.A.

(57) ABSTRACT

A ratchet wrench includes a body having a head and a shank interconnected to the head. The head includes a driving hole extending along a first axis and receiving a driving device. The shank includes a transmission hole receiving a transmission shaft. An axis fixing device is mounted in a transmission groove between the driving hole and the transmission hole and includes an axial hole extending through the axis fixing device along a second axis that extends perpendicularly to and intersects with the first axis. A gear coupled to the driving device is received in the axial hole and is rotatable about the second axis. A driving end of the transmission shaft extends into the axial hole and is connected to the gear.

19 Claims, 7 Drawing Sheets

(56) References Cited

FOREIGN PATENT DOCUMENTS

| | | | |
|---|---|---|---|
| TW | I305741 | B | 2/2009 |
| TW | M377293 | U | 4/2010 |
| TW | M505378 | U | 7/2015 |

* cited by examiner

AXIS FIXING DEVICE FOR A RATCHET WRENCH AND RATCHET WRENCH INCLUDING THE SAME

BACKGROUND OF THE INVENTION

The present invention relates to an axis fixing device and, more particularly, to an axis fixing device for a ratchet wrench. The present invention also relates to a ratchet wrench including the axis fixing device.

U.S. Pat. No. 5,709,136 entitled "POWER DRIVEN TOOLS" discloses a power driven wrench including a head, a drive adapter for a handle, and a rotatable power drive. The head receives a rotatable socket member for connecting to a screw or a bolt. The socket member includes a plurality of gear teeth thereon extending circularly around the socket member and around the axis thereof. The drive adapter includes an outer elongated housing having a central axial bore. Mounted on bearings in the central axial bore is an elongated rotatable drive shaft. A rotary beveled input gear is mounted on the inner end of the drive shaft. The teeth of the rotary beveled input gear mesh with the gear teeth around the socket member for rotation thereof on an axis perpendicular to the axis of the rotation of the drive shaft.

However, during the drilling process for forming the central axial bore of the housing of the power driven wrench, the elongated outline of the housing increases difficulties in bore drilling. Namely, the drilling machine must use a bit with a sufficient length corresponding to the elongated outline of the housing. However, the bending extent of the bit increases when the ratio of the length to the diameter of the bit are larger, such that the bit has to withstand the bending force during the bore drilling process and, thus, flexes, leading to an increase in the error of the bore diameter. After the drilling process, the axis of the central axial bore will inevitably deviate from the axis of the housing. Namely, the central axial bore is defined in the housing along an unideal axis, resulting in an excessive concentricity error between the central axial bore and the housing. Thus, when the drive shaft is mounted in the central axial bore, the rotating axis of the drive shaft will not be perpendicular to the rotating axis of the socket member. As a result, the teeth of the rotary beveled input gear cannot smoothly mesh with the gear teeth of the socket member. The torque of the power drive cannot be transmitted completely through the drive shaft to the socket member. After a long period of use, the rotary beveled input gear and the socket member are subject to damage, and the power driven wrench cannot be used.

Furthermore, the central axial bore must be processed to include a plurality of grooves for receiving the bearings. The problem of concentricity error also exists between the central axial bore and the grooves, such that the drive shaft cannot rotate smoothly in the central axial bore. As a result, the teeth of the rotary beveled input gear cannot smoothly mesh with the gear teeth of the socket member. The torque of the power drive cannot be transmitted completely through the drive shaft to the socket member.

Thus, a need exists for a novel ratchet wrench that mitigates and/or obviates the above disadvantages.

BRIEF SUMMARY OF THE INVENTION

In a first aspect, a ratchet wrench according to the present invention includes a body having a head and a shank interconnected to the head. The head includes a driving hole extending along a first axis. The shank includes a transmission hole. The body further includes a transmission groove intercommunicated between the driving hole and the transmission hole. A driving device is mounted in the driving hole along the first axis and is adapted to drive a fastener to rotate about the first axis. An axis fixing device is mounted in the transmission groove and includes an axial hole extending along a second axis and extending through a first side of the axis fixing device. The second axis extends perpendicularly to and intersects with the first axis. A transmission device is mounted in the body and includes a gear and a transmission shaft. The gear is received in the axial hole, is rotatable about the second axis, and is coupled to the driving device. The transmission shaft is rotatably received in the transmission hole of the body and includes a driving end and a transmission end. The driving end of the transmission shaft extends into the axial hole of the axis fixing device and is connected to the gear. A power device is connected to the transmission end of the transmission shaft for driving the transmission shaft.

In an example, the transmission groove includes a groove wall having a first surface section. The axis fixing device further includes first and second ends spaced from each other in a direction perpendicular to the second axis. The first end of the axis fixing device is configured to abut the first surface section of the groove wall of the transmission groove. The axis fixing device further includes a first opening extending through the first end and intersecting with the axial hole. The gear is partially exposed outside of the axial fixing device via the first opening and is coupled to the driving device.

In an example, the driving device includes a driving member and a first ring gear. The driving member is received in the driving hole and is rotatable about the first axis. The first ring gear is rotatably mounted to the driving member and is configured to drive the driving member. The axis fixing device further includes a first evasive groove extending in a direction parallel to the second axis, formed in the first end, and intercommunicated with the first opening. The first ring gear is partially received in the first evasive groove and meshes with the gear.

In an example, the transmission groove includes a first side intercommunicated with the driving hole and a second side intercommunicated with the transmission hole. The groove wall of the transmission groove further includes a peripheral surface located at the second side of the transmission groove. The peripheral surface is interconnected to and extends perpendicularly to the first surface section. The transmission hole extends through the peripheral surface. The first side of the axis fixing device includes an outer wall face. The outer wall face is configured to abut the peripheral surface of the groove wall of the transmission groove.

In an example, the axis fixing device further includes a second side having an end face opposite to the outer wall face. The axial hole extends through the end face and the outer wall face. The end face faces the driving device. The driving end of the transmission shaft extends into the axial hole to connect to the gear, such that the axis fixing device is retained between the driving device and the peripheral surface of the transmission groove, preventing the axis fixing device from disengaging from the transmission groove.

In an example, the axis fixing device further includes an extension extending outward from the outer wall face along the second axis. The axial hole extends through the extension. The extension is received in the transmission hole of the ratchet wrench. A gap exists between the extension and an inner periphery of the transmission hole.

In an example, each of the end face and the outer wall face is a curved face, and the axis fixing device has crescent cross sections orthogonal to a plane that is parallel to the second axis and perpendicular to the first axis.

In an example, the axis fixing device further includes a second opening formed in the second end and intercommunicated with axial hole. The axis fixing device further includes a second evasive groove extending in the direction parallel to the second axis, formed in the second end, and intercommunicated with the second opening. The driving device further includes a second ring gear partially received in the second evasive groove and meshed with the gear.

In an example, the axis fixing device further includes at least one positioning protrusion formed on the outer wall face. The peripheral surface of the transmission groove includes at least one positioning recess. The at least one positioning protrusion is engaged in the at least one positioning recess of the transmission groove.

In an example, the axial hole of the axis fixing device has an inner diameter perpendicular to the second axis. The gear has an outer diameter perpendicular to the second axis. The inner diameter is smaller than the outer diameter.

In an example, the transmission hole has a first length along the second axis. The axis fixing device has a second length along the second axis. A ratio of the first length to the second length is larger than 10.

In an example, the first opening has an opening length along the second axis. The gear has a gear length along the second axis. The opening length is not smaller than the gear length.

In a second aspect, an axis fixing device is provided for a ratchet wrench and is adapted to be mounted in a transmission groove of the ratchet wrench. The transmission groove is located between a driving hole and a transmission hole of the ratchet wrench. The driving hole extends along a first axis. The ratchet wrench includes a driving device mounted in the driving hole. The driving device is adapted to drive a fastener to rotate about the first axis. The ratchet wrench farther includes a transmission device rotatably mounted in the transmission hole. The axis fixing device includes an axial hole extending to a first side of the axis fixing device along a second axis. The second axis intersects with and extends perpendicularly to the first axis when the axis fixing device is mounted in the transmission groove of the ratchet wrench. The transmission device is adapted to extend into the axial hole and connect to the driving device.

In an example, the axis fixing device further includes first and second ends spaced from each other in a direction perpendicular to the second axis. The first end of the axis fixing device is configured to abut a first surface section of a groove wall of the transmission groove of the ratchet wrench. The axis fixing device further includes an opening extending through the first end and intersecting with the axial hole. The transmission device of the ratchet wrench is adapted to be partially exposed outside of the axial fixing device via the opening for connection with the driving device.

In an example, the axis fixing device further includes a first evasive groove extending in a direction parallel to the second axis, formed in the first end, and intersecting with the opening. The driving device is adapted to be partially received in the first evasive groove and coupled to the transmission device.

In an example, the first side of the axis fixing device includes an outer wall face. The outer wall face is configured to abut a peripheral surface of the groove wall of the transmission groove. The peripheral surface is interconnected to and extends perpendicularly to the first surface section. The axial hole extends through the outer wall face.

In an example, the axis fixing device further includes a second side having an end face opposite to the outer wall face. The axial hole extends through the end face and the outer wall face. When the axis fixing device is mounted in the transmission groove of the ratchet wrench, the end face faces the driving device of the ratchet wrench, and the transmission device extends into the axial hole to connect to the driving device, such that the axis fixing device is retained between the driving device and the peripheral surface of the transmission groove, preventing the axis fixing device from disengaging from the transmission groove.

In an example, the axis fixing device further including an extension extending outward from the outer wall face along the second axis. The axial hole extends through the extension. The extension is configured to extend into the transmission hole. A gap exists between the extension and an inner periphery of the transmission hole.

In an example, each of the end face and the outer wall face is a curved face. The axis fixing device has crescent cross sections orthogonal to a plane that is parallel to the second axis and perpendicular to the first axis.

In an example, the axis fixing device further includes at least one positioning protrusion formed on the outer wall face. The peripheral surface of the transmission groove of the ratchet wrench includes at least one positioning recess. The at least one positioning protrusion is engaged in the at least one positioning recess of the transmission groove.

The present invention will become clearer in light of the following detailed description of illustrative embodiments of this invention described in connection with the drawings.

DETAILED DESCRIPTION OF THE INVENTION

Figure 1:
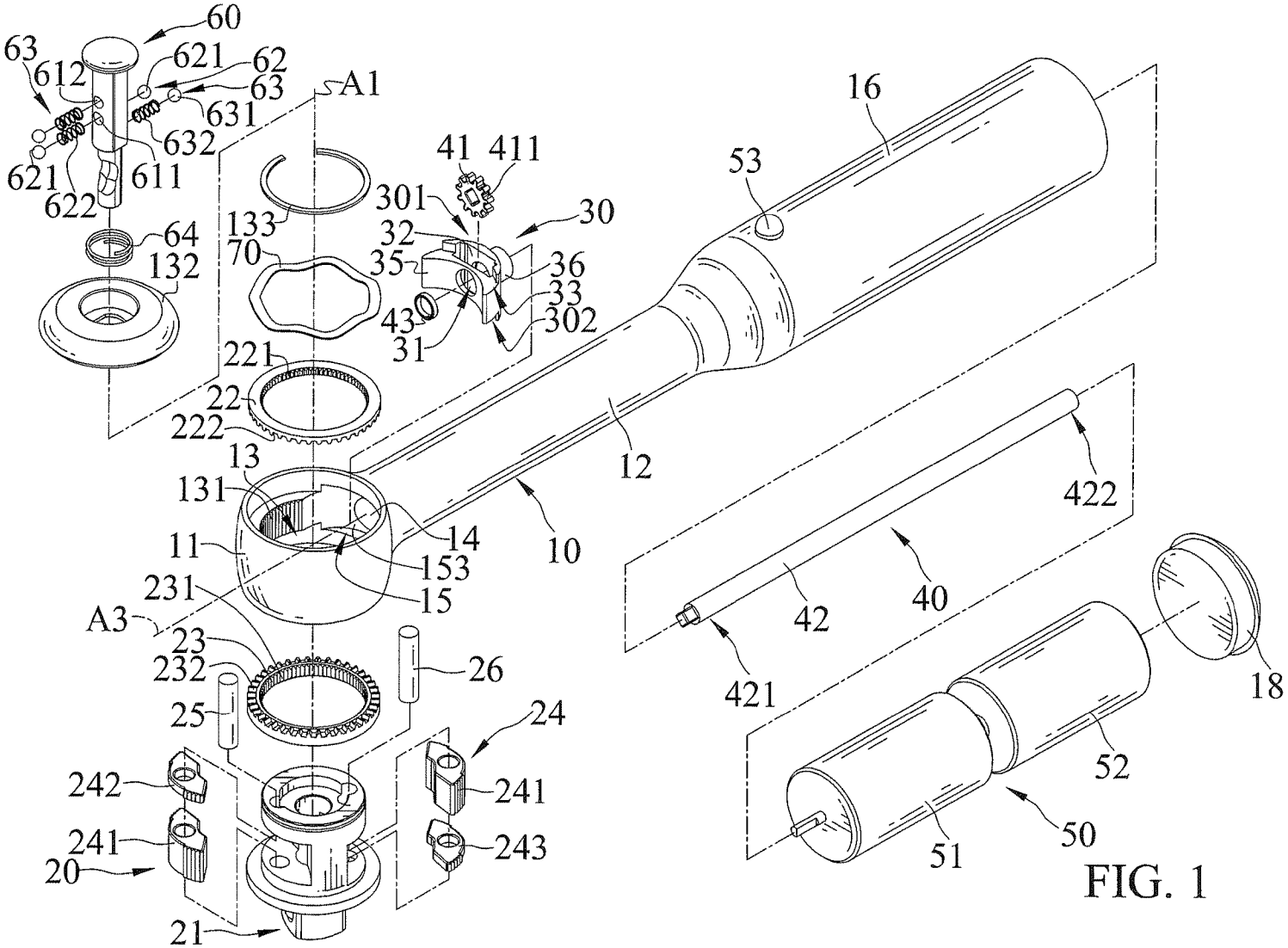
FIG. 1 is an exploded, perspective view of a ratchet wrench of a first embodiment according to the present invention.
Figure 2:
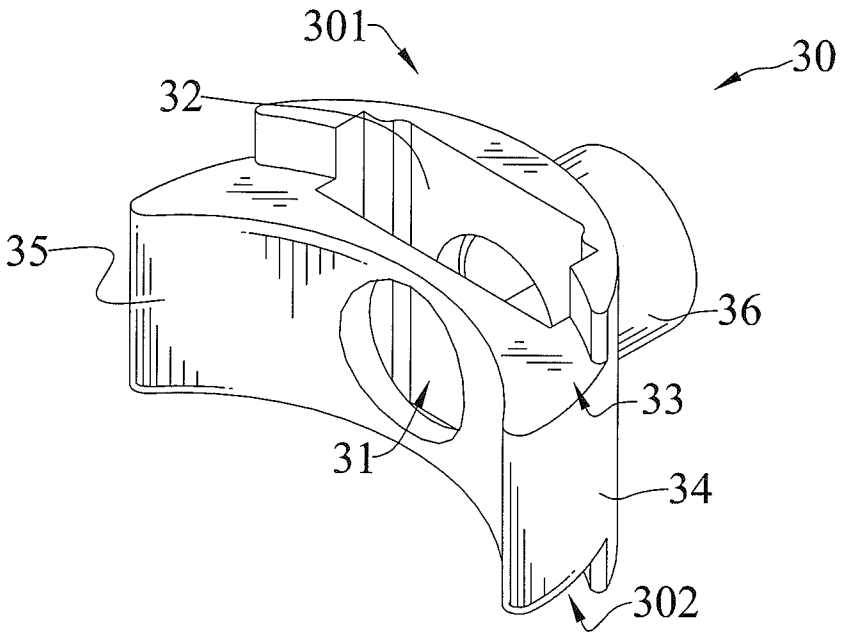
FIG. 2 is a perspective view of an axis fixing device of the ratchet wrench of FIG. 1.
Figure 3:
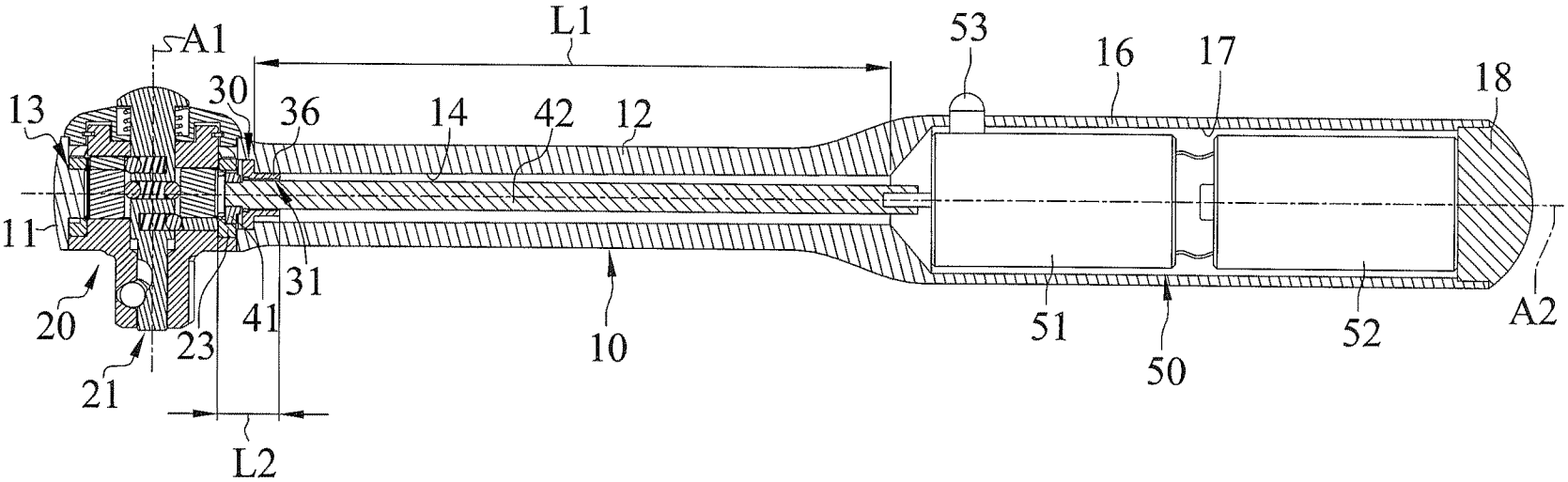
FIG. 3 is a cross sectional view of the ratchet wrench of FIG. 1.
Figure 4:
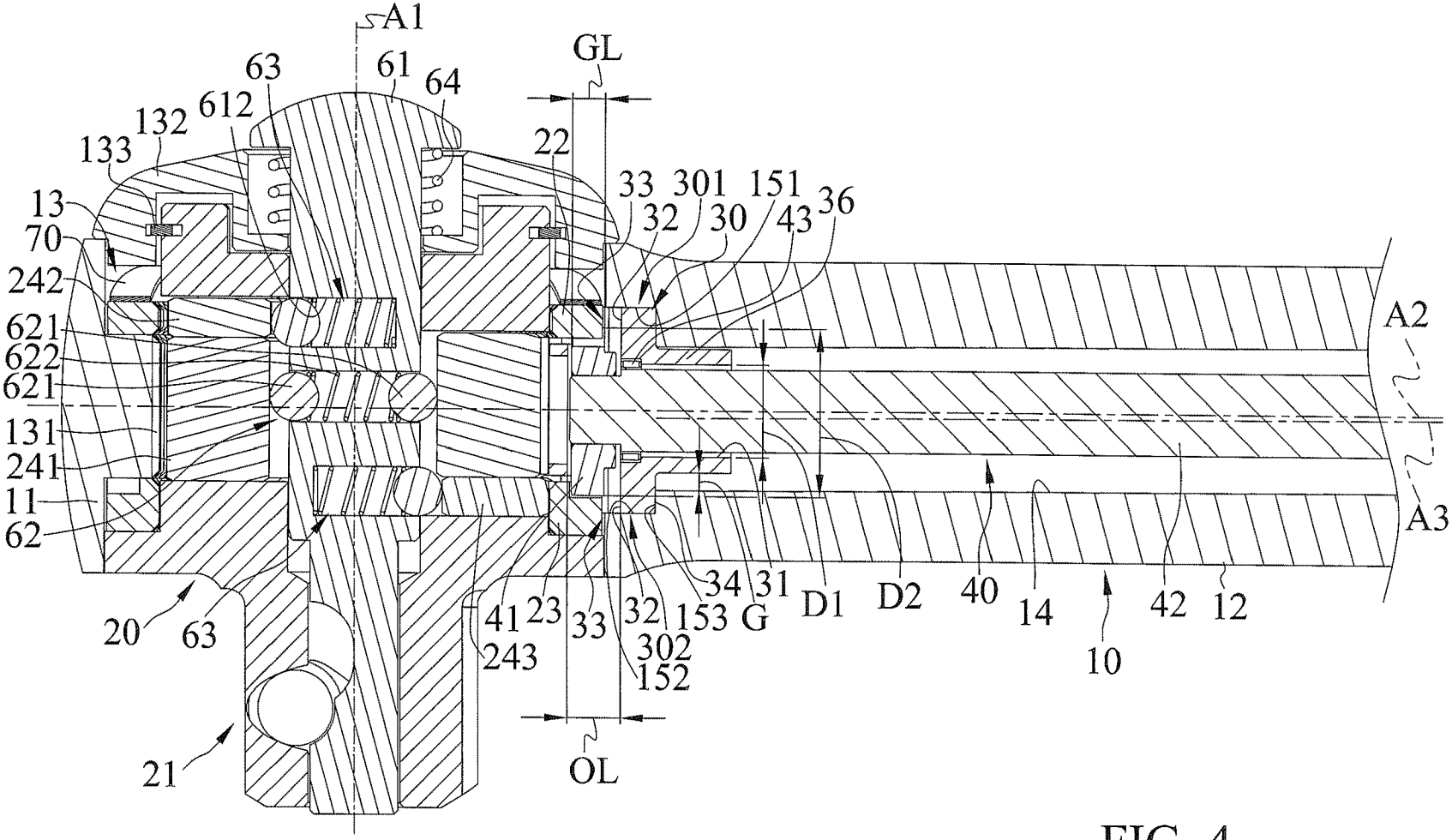
FIG. 4 is an enlarged view of a portion of FIG. 3.
Figure 5:
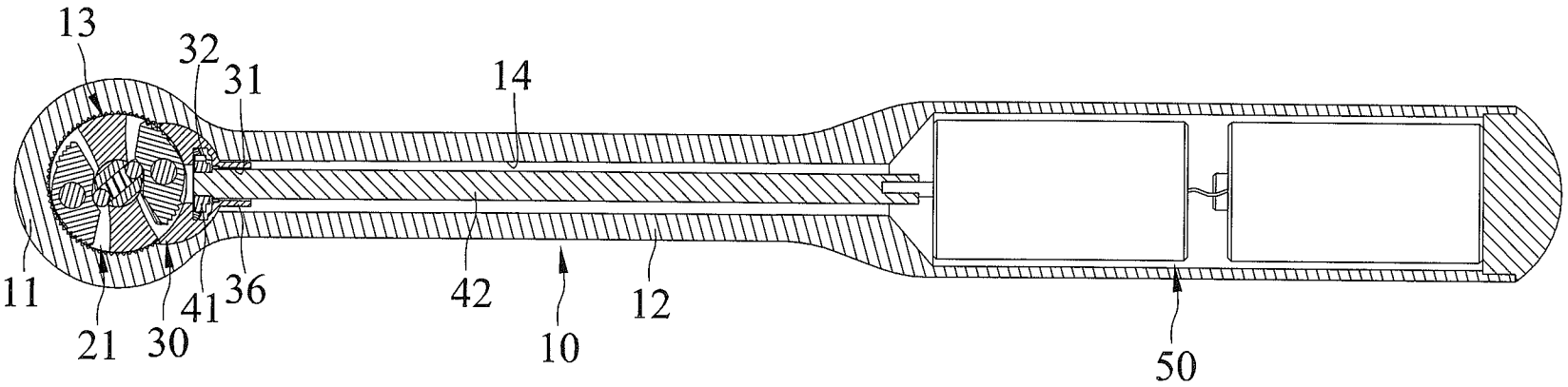
FIG. 5 is another cross sectional view of the ratchet wrench of FIG. 1.
Figure 6:
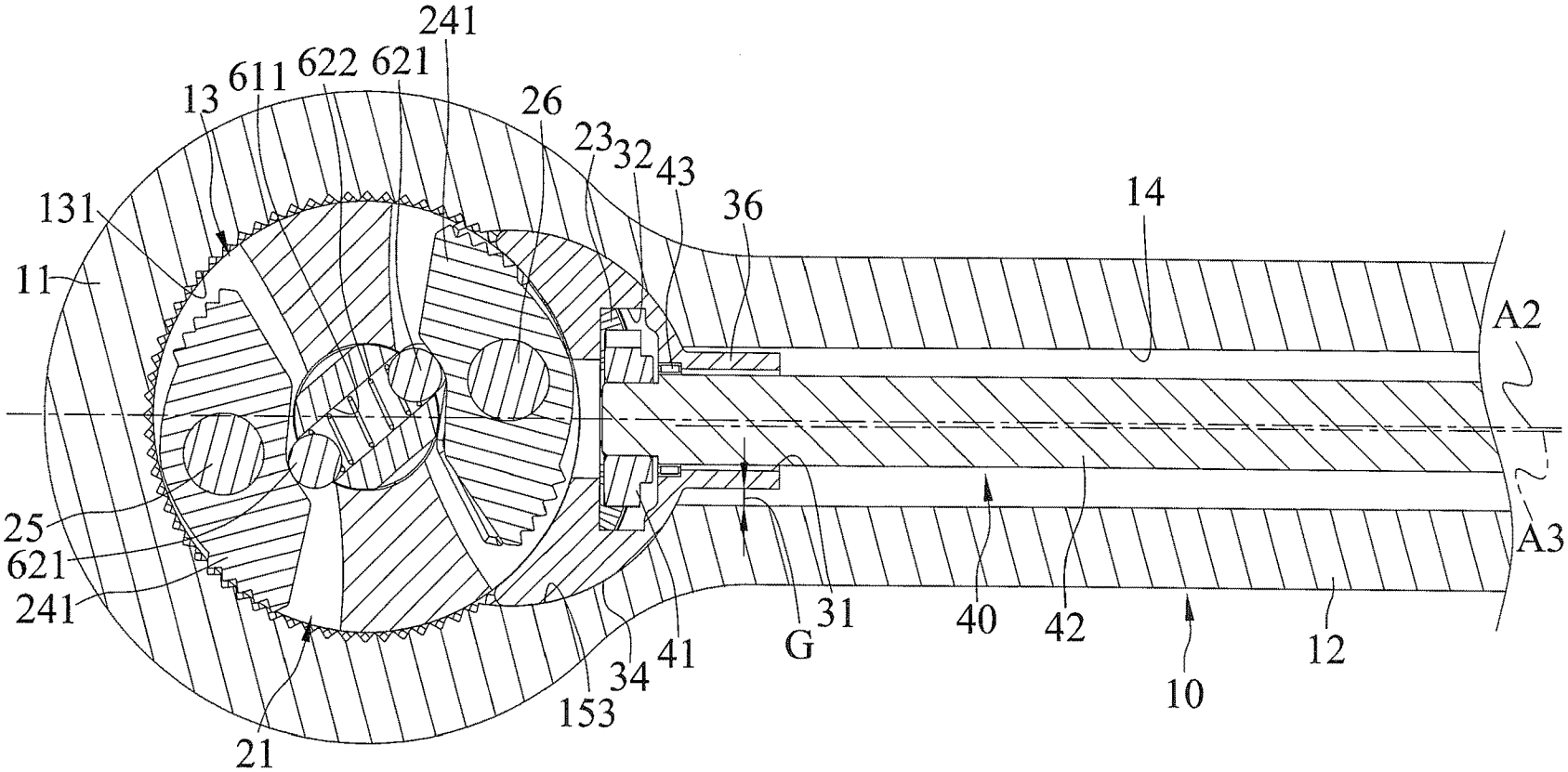
FIG. 6 is an enlarged view of a portion of FIG. 5, and illustrates a gear partially exposed outside of the axis fixing device.

With reference to FIGS. 1-6, a ratchet wrench of a first embodiment according to the present invention includes a body 10, a driving device 20, an axis fixing device 30, a transmission device 40, and a power device 50. The ratchet wrench of this embodiment is in the form of a fast driving type. However, the ratchet wrench can be of other types.

Body 10 includes a head 11 and a shank 12 interconnected to the head 11. In this embodiment, head 11 and shank 12 are integrally formed as an inseparable member. Head 11 includes a driving hole 13 extending along a first axis A1. Shank 12 includes a transmission hole 14. Body 10 further includes a transmission groove 15 intercommunicated between driving hole 13 and transmission hole 14.

Driving device 20 is mounted in driving hole 13 along first axis A1 and is adapted to directly or indirectly drive a fastener (such as a bolt, a nut, a socket, etc.) to rotate about first axis A1.

Axis fixing device 30 is mounted in transmission groove 15 and includes an axial hole 31 extending along a second axis A2 and extending through a first side of axis fixing device 30. Preferably, when axis fixing device 30 is mounted in transmission groove 15, second axis A2 extends perpendicularly to and intersects with first axis A1.

Transmission device 40 is mounted in body 10 and includes a gear 41 and a transmission shaft 42. Gear 41 is received in the axial hole 31, is rotatable about second axis A2, and is coupled to driving device 20. Transmission shaft 42 is rotatably received in transmission hole 14 and includes a driving end 421 and a transmission end 422. Driving end 421 of transmission shaft 42 extends into axial hole 31 and is connected to gear 41. A bearing 43 is mounted around driving end 421 of transmission shaft 42.

Power device 50 is connected to transmission end 422 of transmission shaft 42 for driving transmission shaft 42. The power source for power device 50 can be human labor, electricity, hydraulic pressure, pneumatic pressure, etc.

By providing axis fixing device 30 in transmission groove 15 between driving hole 13 and transmission hole 14 and by mounting driving device 20 in driving hole 13 along first axis A1, gear 41 of transmission device 40 is partially received in axial hole 31 of axis fixing device 30, is connected to driving device 20, and is rotatable about second axis A2 perpendicular to first axis A1. Thus, even if transmission hole 14 is formed in body 10 during processing and extends along a third axis A3 which is not coincident with second axis A2 (namely, third axis A3 is an unideal axis generated during processing and is parallel to and spaced from first axis A1 or at a non-parallel angle to first axis A1, see FIGS. 4 and 6), axis fixing device 30 can assure gear 41 rotates about second axis A2 perpendicular to first axis A1, assuring reliable coupling with driving device 20. As a result, the torque from power device 50 can be completely transmitted through transmission shaft 42 and gear 41 of transmission device 40 to driving device 20, prolonging the service life of the ratchet wrench.

Transmission groove 15 includes a groove wall having a first surface section 151 and a second surface section 152 opposite to first surface section 151 in a direction perpendicular to second axis A2. Axis fixing device 30 further includes first and second ends 301 and 302 spaced from each other in the direction perpendicular to the second axis A2. First and second ends 301 and 302 of the axis fixing device 30 are configured to respectively abut first and second surface sections 151 and 152 of the groove wall of transmission groove 15. Axis fixing device 30 further includes a first opening 32 extending through first end 301 and intersecting with axial hole 31. Axis fixing device 30 further includes a second opening 32 extending through second end 302 and intersecting with axial hole 31. Gear 41 includes an outer periphery with teeth 411, some of which are partially exposed outside of axis fixing device 30 via first and second openings 32 to mesh with the driving device 20.

In assembly, gear 41 is placed into axis fixing device 30 via one of first and second openings 32, and axis fixing device 30 is then placed into transmission groove 15, such that first and second ends 301 and 302 of axis fixing device 30 respectively abut first and second surface sections 151 and 152 of transmission groove 15 to achieve a positioning effect along second axis A2. Next, transmission shaft 42 is mounted in transmission hole 14. Driving end 421 of transmission shaft 42 extends into axial hole 31 of axis fixing device 30 and is connected to gear 41, accomplishing the assembly. The assembling process is simple, and a person proceeding with the assembly does not need any auxiliary positioning tool to make gear 41 coincident with second axis A2. Alternatively, axis fixing device 30 can be mounted in transmission groove 15 before placing gear 41 into axis fixing device 30 via one of first and second openings 32.

Driving device 20 includes a driving member 21 and a first ring gear 22. Driving member 21 is received in driving hole 13 and is rotatable about first axis A1. First ring gear 22 is rotatably mounted to driving member 21 and is configured to drive driving member 21. Axis fixing device 30 further includes a first evasive groove 33 extending in a direction parallel to second axis A2, formed in first end 301, and intercommunicated with one of first and second openings 32. First ring gear 22 is partially received in first evasive groove 33 and meshes with teeth 411 of gear 41. Thus, first ring gear 22 can be smoothly driven to rotate relative to driving member 21. Furthermore, axis fixing device 30 cannot disengage from transmission groove 15 and cannot move toward driving hole 13 along second axis A2.

In this embodiment, driving device 20 further includes a second ring gear 23 rotatably mounted to driving member 21 for driving the driving member 21. First and second ring gears 22 and 23 can rotate relative to driving member 21 about first axis A1 in a clockwise direction or a counterclockwise direction and are located on opposite sides of driving member 21 along first axis A1. In this embodiment, axis fixing device 30 further includes a second evasive groove 33 formed in second end 302 and intercommunicated with second opening 32. First and second ring gears 22 and 23 are respectively and partially received in first and second evasive grooves 33 and mesh with teeth 411 of gear 41.

Transmission groove 15 includes a first side intercommunicated with driving hole 13 and a second side intercommunicated with transmission hole 14. The groove wall of transmission groove 15 further includes a peripheral surface 153 located at the second side of transmission groove 15. Peripheral surface 153 is interconnected to and extends perpendicularly to first and second surface sections 151 and 152. Transmission hole 14 extends through peripheral surface 153. The first side of axis fixing device 30 includes an outer wall face 34 configured to abut peripheral surface 153 of the groove wall of transmission groove 15. Thus, axis fixing device 30 is positioned at the second side of transmission groove 15 opposite to driving hole 13.

Axis fixing device 30 further includes a second side having an end face 35 opposite to outer wall face 34. Axial hole 31 extends through end face 35 and outer wall face 34. End face 35 faces driving device 20. Each of end face 35 and outer wall face 34 is a curved face. Axis fixing device 30 has crescent cross sections orthogonal to a plane that is parallel to second axis A2 and perpendicular to first axis A1.

Axis fixing device 30 further includes an extension 36 extending outward from outer wall face 34 along second axis A2. Axial hole 31 extends through extension 36. Extension 36 is received in transmission hole 14, and a gap G exists between extension 36 and an inner periphery of transmission hole 14.

Axial hole 31 of axis fixing device 30 has an inner diameter D1 perpendicular to second axis A2. Gear 41 has an outer diameter D2 perpendicular to second axis A2. Inner diameter D1 is smaller than outer diameter D2 to avoid gear 41 from disengaging out of axis fixing device 30 via axial hole 31.

Each of first and second openings 32 has an opening length OL along second axis A2. Gear 41 has a gear length GL along second axis A2. Opening length OL is not smaller than gear length GL, such that a person proceeding with assembly can place gear 41 into axis fixing device 30 via one of first and second openings 32.

Transmission hole 14 has a first length L1 along second axis A2. Axis fixing device 30 has a second length L2 along second axis A2. In this embodiment, a ratio of first length L1 to second length L2 is larger than 10. By mounting axis fixing device 30 in transmission groove 15, even though the ratio of first length L1 to second length L2 is larger than 10, gear 41 can be positioned in axial hole 31 of axis fixing device 30 to reliably rotate along second axis A2 and to connect to driving device 20, such that the torque of power device 50 can be completely transmitted through transmission shaft 42 and gear 41 to driving device 20 while prolonging the service life of the ratchet wrench.

In this embodiment, body 10 further includes a handle 16 integrally formed with shank 12 and defining a receiving compartment 17 for receiving power device 50. A detachable cap 18 is provided to seal receiving compartment 17 for preventing power device 50 from disengaging from receiving compartment 17.

In this embodiment, power device 50 is an electric device received in receiving compartment 17 and includes a motor 51, a power source 52, and a control button 53. Motor 51 is connected to transmission end 422 of transmission shaft 42. Power source 52 is electrically connected to motor 51 and drives transmission shaft 42 to rotate. Control button 53 is electrically connected to motor 51 for controlling operation of motor 51.

Driving hole 13 includes an inner periphery having a toothed section 131 with a plurality of teeth. Body 10 further includes a substantially circular cap 132 for closing a side of driving hole 13 along first axis A1. A retaining member 133 is mounted in driving hole 13 and is coupled to cap 132.

Driving device 20 further includes a pawl device 24 mounted between first and second ring gears 22 and 23. Pawl device 24 includes two primary pawls 241, a first secondary pawl 242, and a second secondary pawl 243. Two primary pawls 241 are pivotably mounted to driving member 21 and selectively mesh with toothed portion 131 of driving hole 13. A first pin 25 extends through driving member 21, one of two primary pawls 241, and first secondary pawl 242, such that the one of two primary pawls 241 and first secondary pawl 242 are coaxially and pivotably mounted to driving member 21 about a pivotal axis defined by first pin 25. A second pin 26 extends through driving member 21, the other primary pawl 241, and second secondary pawl 243, such that the other primary pawl 241 and second secondary pawl 243 are coaxially and pivotably mounted to driving member 21 about a pivotal axis defined by second pin 26. The pivotal axes defined by first and second pins 25 and 26 are parallel to first axis A1. The two primary pawls 241 are on the same level along first axis A1. First secondary pawl 242 and second secondary pawl 243 are located on opposite sides of driving member 21 in a radial direction perpendicular to first axis A1 and are located on different levels along first axis A1. The two primary pawls 241 are located between first secondary pawl 242 and second secondary pawl 243 along first axis A1.

First ring gear 22 and second ring gear 23 can rotate relative to driving member 21 about first axis A1 in a clockwise direction or a counterclockwise direction and are located on opposite sides of driving member 21 along first axis A1. First ring gear 22 includes an inner toothed portion 221 selectively meshed with first secondary pawl 242 and a side toothed portion 222 meshed with teeth 411 of gear 41. Second ring gear 23 includes an inner toothed portion 231 selectively meshed with second secondary pawl 243 and a side toothed portion 232 meshed with teeth 411 of gear 41.

Primary pawls 241, first secondary pawl 242, and second secondary pawl 243 can be of any desired form as conventional including but not limited to of a commercially available type.

The ratchet wrench further includes a direction switching device 60. Direction switching device 60 includes a direction switching rod 61 extending through cap 132 and driving member 21. Direction switching device 60 further includes a primary pressing unit 62, two secondary pressing units 63, and a returning element 64. Direction switching rod 61 is pivotable about first axis A1 between two positions corresponding to a driving direction and a non-driving direction. When the direction switching rod 61 pivots between the two positions, the engagement status between the two primary pawls 241 and toothed section 131 of driving hole 13, the engagement status between first secondary pawl 242 and first ring gear 22, and the engagement status between second secondary pawl 243 and second ring gear 23 can be changed to provide a direction switching function.

Direction switching rod 61 includes a through-hole 611 and two receptacles 612. Through-hole 611 extends through direction switching rod 61 in a radial direction perpendicular to first axis A1 and is located between the two receptacles 612 along first axis A1. Openings of the two receptacles 612 are diametrically opposed to each other in a radial direction perpendicular to first axis A1.

The primary pressing unit 62 is mounted in through-hole 611 of direction switching rod 61 and includes two pressing members 621 and a biasing element 622 between pressing members 621. Each pressing member 621 is biased by biasing element 622 to press against one of the two primary pawls 241.

Each secondary pressing unit 63 is mounted in one of the two receptacles 612 and includes a pressing member 631 and a biasing element 632. In one of the two secondary pressing units 63, pressing member 631 is biased by biasing element 632 to press against first secondary pawl 242. In the other secondary pressing unit 63, pressing member 631 is biased by biasing element 632 to press against second secondary pawl 243. Thus, a user can pivot direction switching rod 61 about first axis A1 to change the angular positions of first secondary pawl 242 and second secondary pawl 243 pressed by pressing members 621 and 631 to thereby achieve the direction switching function.

In this embodiment, returning element 64 is a coil spring mounted around direction switching rod 61. Returning element 64 is mounted between direction switching rod 61 and cap 132 and is movable relative to driving member 21 along first axis A1 between an initial position and a disengagement position. When direction switching rod 61 is in the initial position, driving member 21 can couple with a fastener. When direction switching rod 61 is in the disengagement position in which returning element 64 is compressed, the fastener can be disengaged from driving member 21. The elasticity of returning element 64 returns direction switching rod 61 to the initial position, such that direction switching rod 61 is normally in the initial position.

In this embodiment, an elastic element 70 is mounted between first ring gear 22 and cap 132. Elastic element 70 can be a wave spring mounted around driving member 21. With provision of elastic element 70, when a resistance encountered during the process of driving a fastener by driving member 21 is smaller than the torque of power device 50, gear 41 is in the engagement state meshing with side toothed portion 222 of first ring gear 22 and side toothed portion 232 of second ring gear 23. Motor 51 drives transmission shaft 42 to rotate, and teeth 411 of gear 41 drives first and second ring gears 22 and 23 to rotate about first axis A1, thereby rotating driving member 21 to drive the fastener.

If a resistance larger than the torque outputted by motor 51 is encountered at a position while driving member 21 is driving the fastener, the torque outputted by motor 51 is insufficient to drive transmission shaft 42 to rotate driving member 21. Teeth 411 of gear 41 are not in the engagement state and press against first ring gear 22, slightly moving first ring gear 22 relative to driving hole 13 along first axis A1 and compressing elastic element 70. Thus, a tooth slippage phenomenon occurs at teeth 411 of gear 41. Namely, teeth 411 of gear 41 repeatedly engage with and disengage from side toothed portions 222 and 232 of first and second ring gears 22 and 23, such that first and second ring gears 22 and 23 cannot be rotated by gear 41. In this case, the user can manually rotate handle 16, using toothed portion 131 of driving hole 13 to mesh with one of primary pawls 241. Thus, driving member 21 is driven by body 10 to drive the fastener to rotate about first axis A1. After the fastener passes through the large-resistance position, teeth 411 of gear 41 reengage with side toothed portions 222 and 232 of first and second ring gears 22 and 23 under the action of elastic element 70, returning to the engagement state. Thus, the problems of conventional fast-driving ratchet wrenches resulting from excessive large resistances are overcome.

Figure 7:
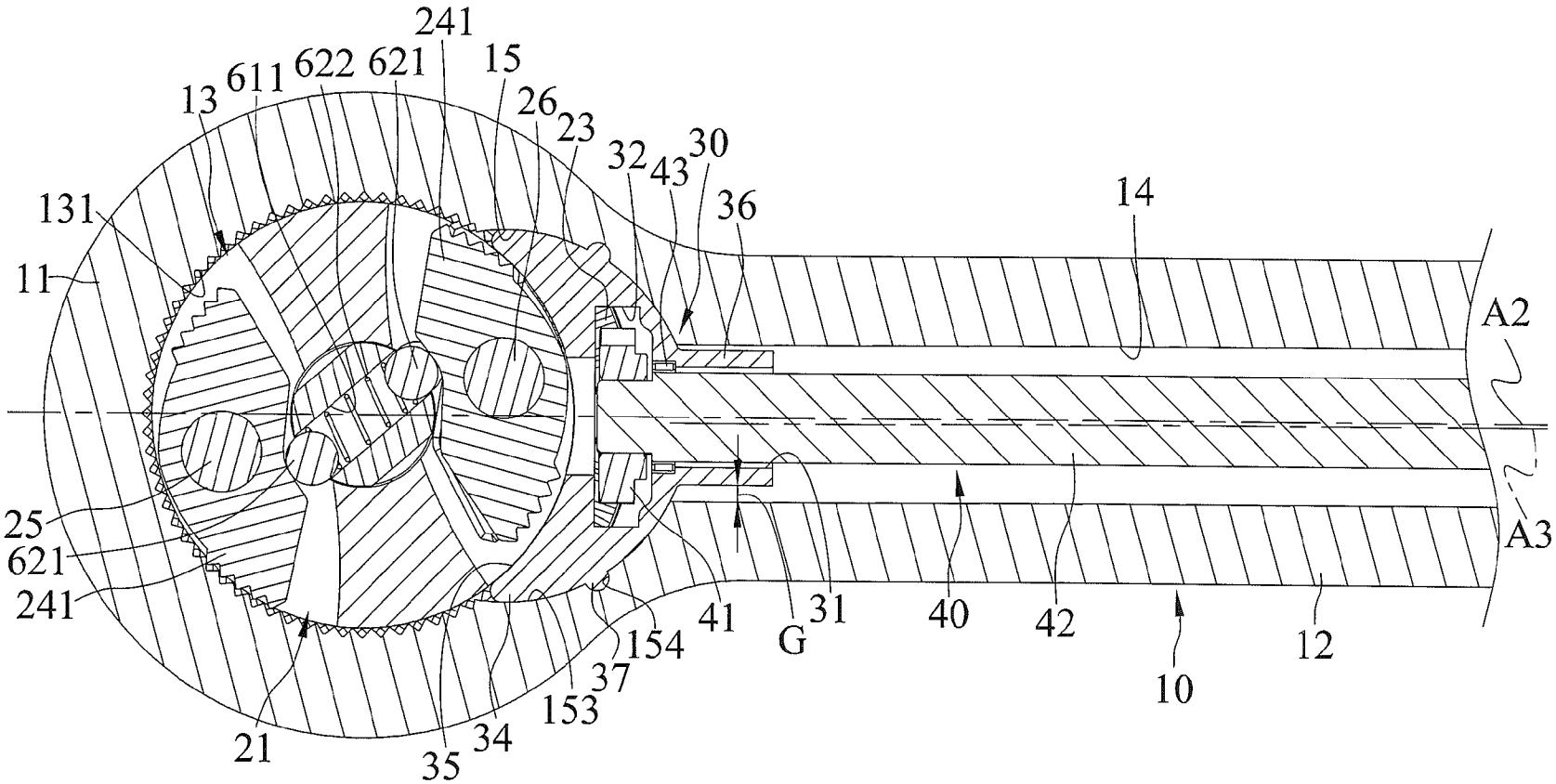
FIG. 7 is a partial, enlarged cross sectional view of a ratchet wrench of a second embodiment according to the present invention, and illustrates a positioning protrusion engaged in one of the positioning recesses.

FIG. 7 shows a ratchet wrench of a second embodiment according to the present invention. In the second embodiment, peripheral surface 153 of transmission groove 15 includes at least one positioning recess 154, axis fixing device 30 further includes at least one positioning protrusion 37 formed on outer wall face 34, and the at least one positioning protrusion 37 is engaged in the at least one positioning recess 154 of transmission groove 15. This increases the effect of positioning axis fixing device 30 in transmission groove 15. In this embodiment, transmission groove 15 includes two positioning recesses 154 symmetrically defined in peripheral surface 153, and axis fixing device 30 includes two positioning protrusions 37 symmetrically formed on outer wall face 34 and located corresponding to the two positioning recesses 154, thereby increasing the positioning effect of axis fixing device 30 in transmission groove 15.

Although specific embodiments have been illustrated and described, numerous modifications and variations are still possible without departing from the scope of the invention. The scope of the invention is limited by the accompanying claims.

The invention claimed is:

1. A ratchet wrench comprising: a body including a head and a shank interconnected to the head, with the head including a driving hole extending along a first axis, with the shank including a transmission hole, with the body further including a transmission groove intercommunicated between the driving hole and the transmission hole; a driving device mounted in the driving hole along the first axis and adapted to drive a fastener to rotate about the first axis; an axis fixing device mounted in the transmission groove, with the axis fixing device including an axial hole extending along a second axis and extending through a first side of the axis fixing device, and with the second axis extending perpendicularly to and intersecting with the first axis; a transmission device mounted in the body and including a gear and a transmission shaft, with the gear received in the axial hole, rotatable about the second axis, and coupled to the driving device, with the transmission shaft rotatably received in the transmission hole of the body and including a driving end and a transmission end, with the driving end of the transmission shaft extending into the axial hole of the axis fixing device and connected to the gear; and a power device connected to the transmission end of the transmission shaft for driving the transmission shaft.

2. The ratchet wrench as claimed in claim 1, with the transmission groove including a groove wall having a first surface section, with the axis fixing device further including first and second ends spaced from each other in a direction perpendicular to the second axis, with the first end of the axis fixing device configured to abut the first surface section of the groove wall of the transmission groove, with the axis fixing device further including a first opening extending through the first end and intersecting with the axial hole, and with the gear partially exposed outside of the axial fixing device via the first opening and coupled to the driving device.

3. The ratchet wrench as claimed in claim 2, with the driving device including a driving member and a first ring gear, with the driving member received in the driving hole and rotatable about the first axis, with the first ring gear rotatably mounted to the driving member and configured to drive the driving member, with the axis fixing device further including a first evasive groove extending in a direction parallel to the second axis, formed in the first end, and intercommunicated with the first opening, and with the first ring gear partially received in the first evasive groove and meshed with the gear.

4. The ratchet wrench as claimed in claim 3, with the transmission groove including a first side intercommunicated with the driving hole and a second side intercommunicated with the transmission hole, with the groove wall of the transmission groove further including a peripheral surface located at the second side of the transmission groove, with the peripheral surface interconnected to and extending perpendicularly to the first surface section, with the transmission hole extending through the peripheral surface, with the first side of the axis fixing device including an outer wall face, with the outer wall face configured to abut the peripheral surface of the groove wall of the transmission groove.

5. The ratchet wrench as claimed in claim 4, with the axis fixing device further including a second side having an end face opposite to the outer wall face, with the axial hole extending through the end face and the outer wall face, with the end face facing the driving device, with the driving end of the transmission shaft extending into the axial hole to connect to the gear, such that the axis fixing device is retained between the driving device and the peripheral surface of the transmission groove, preventing the axis fixing device from disengaging from the transmission groove.

6. The ratchet wrench as claimed in claim 5, with the axis fixing device further including an extension extending outward from the outer wall face along the second axis, with the axial hole extending through the extension, with the extension received in the transmission hole of the ratchet wrench, and with a gap existing between the extension and an inner periphery of the transmission hole.

7. The ratchet wrench as claimed in claim 6, with each of the end face and the outer wall face being a curved face, and with the axis fixing device having crescent cross sections orthogonal to a plane that is parallel to the second axis and perpendicular to the first axis.

8. The ratchet wrench as claimed in claim 6, with the axis fixing device further including a second opening formed in the second end and intercommunicated with the axial hole, with the axis fixing device further including a second evasive groove extending in the direction parallel to the second axis, formed in the second end, and intercommunicated with the second opening, and with the driving device further including a second ring gear partially received in the second evasive groove and meshed with the gear.

9. The ratchet wrench as claimed in claim 2, with the first opening having an opening length along the second axis, and with the gear having a gear length along the second axis, wherein the opening length is not smaller than the gear length.

10. The ratchet wrench as claimed in claim 4, with the axis fixing device further including at least one positioning protrusion formed on the outer wall face, with the peripheral surface of the transmission groove including at least one positioning recess, and with the at least one positioning protrusion engaged in the at least one positioning recess of the transmission groove.

11. The ratchet wrench as claimed in claim 1, with the axial hole of the axis fixing device having an inner diameter perpendicular to the second axis, and with the gear having an outer diameter perpendicular to the second axis, wherein the inner diameter is smaller than the outer diameter.

12. The ratchet wrench as claimed in claim 1, with the transmission hole having a first length along the second axis, and with the axis fixing device having a second length along the second axis, wherein a ratio of the first length to the second length is larger than 10.

13. An axis fixing device for a ratchet wrench, with the axis fixing device adapted to be mounted in in a transmission groove of the ratchet wrench, with the transmission groove located between a driving hole and a transmission hole of the ratchet wrench, with the driving hole extending along a first axis, with the ratchet wrench including a driving device mounted in the driving hole, with the driving device adapted to drive a fastener to rotate about the first axis, with the ratchet wrench further including a transmission device rotatably mounted in the transmission hole, with the axis fixing device comprising:

an axial hole extending a first side of the axis fixing device along a second axis, with the second axis intersecting with and extending perpendicularly to the first axis when the axis fixing device is mounted in the transmission groove of the ratchet wrench, and with the transmission device adapted to extend into the axial hole and connect to the driving device;

first and second ends spaced from each other in a direction perpendicular to the second axis, with the first end of the axis fixing device configured to abut a first surface section of a groove wall of the transmission groove of the ratchet wrench; and an opening extending through the first end and intersecting with the axial hole, with the transmission device of the ratchet wrench adapted to be partially exposed outside of the axial fixing device via the opening for connection with the driving device.

14. The axis fixing device for a ratchet wrench as claimed in claim 13, further comprising a first evasive groove extending in a direction parallel to the second axis, formed in the first end, and intersecting with the opening, with the driving device adapted to be partially received in the first evasive groove and coupled to the transmission device.

15. The axis fixing device for a ratchet wrench as claimed in claim 14, with the first side of the axis fixing device including an outer wall face, with the outer wall face configured to abut a peripheral surface of the groove wall of the transmission groove, with the peripheral surface interconnected to and extending perpendicularly to the first surface section, and with the axial hole extending through the outer wall face.

16. The axis fixing device for a ratchet wrench as claimed in claim 15, with the axis fixing device further including a second side having an end face opposite to the outer wall face, with the axial hole extending through the end face and the outer wall face, wherein when the axis fixing device is mounted in the transmission groove of the ratchet wrench, the end face faces the driving device of the ratchet wrench, and the transmission device extends into the axial hole to connect to the driving device, such that the axis fixing device is retained between the driving device and the peripheral surface of the transmission groove, preventing the axis fixing device from disengaging from the transmission groove.

17. The axis fixing device for a ratchet wrench as claimed in claim 16, with the axis fixing device further including an extension extending outward from the outer wall face along the second axis, with the axial hole extending through the extension, with the extension configured to extend into the transmission hole, and with a gap existing between the extension and an inner periphery of the transmission hole.

18. The axis fixing device for a ratchet wrench as claimed in claim 17, with each of the end face and the outer wall face being a curved face, and with the axis fixing device having crescent cross sections orthogonal to a plane that is parallel to the second axis and perpendicular to the first axis.

19. The axis fixing device for a ratchet wrench as claimed in claim 13, with the axis fixing device further including at least one positioning protrusion formed on the outer wall face, with the peripheral surface of the transmission groove of the ratchet wrench including at least one positioning recess, and with the at least one positioning protrusion engaged in the at least one positioning recess of the transmission groove.

* * * * *